US006196838B1

(12) United States Patent
Lukase et al.

(10) Patent No.: US 6,196,838 B1
(45) Date of Patent: Mar. 6, 2001

(54) APPARATUS AND METHOD FOR BOVINE OVERDENTURE

(76) Inventors: Stephen P. Lukase, 7741 W. Michigan Ave., Glendale, AZ (US) 85308; Thomas A. Lukase, 2670 Greentree La., LaJolla, CA (US) 92037

( * ) Notice: Subject to any disclaimer, the term of this patent is extended or adjusted under 35 U.S.C. 154(b) by 0 days.

(21) Appl. No.: 09/607,663

(22) Filed: Jun. 30, 2000

(51) Int. Cl.[7] ..... A61D 5/00
(52) U.S. Cl. ..... 433/1
(58) Field of Search ..... 433/1, 136, 140

(56) References Cited

U.S. PATENT DOCUMENTS

| | | | |
|---|---|---|---|
| 3,046,657 | 7/1962 | Menter et al. | 32/12 |
| 3,055,109 | 9/1962 | Newcomb | 32/12 |
| 3,140,543 | 7/1964 | Menter | 32/12 |
| 3,266,146 | 8/1966 | Bedford, Jr. | 32/12 |
| 3,462,838 | 8/1969 | Alstergren | 32/12 |
| 3,747,215 | 7/1973 | Joyner, Jr. | 32/13 |
| 4,259,073 | 3/1981 | Emmons | 433/177 |
| 4,302,184 | 11/1981 | Carney | 433/1 |
| 4,380,888 * | 4/1983 | Lanham | 433/1 |
| 5,718,665 * | 2/1998 | Stubbs | 600/243 |

* cited by examiner

*Primary Examiner*—Nicholas D. Lucchesi
(74) *Attorney, Agent, or Firm*—Cahill, Sutton & Thomas P.L.C.

(57) ABSTRACT

After immobilizing a bovine, a harness is placed about the head of the bovine to serve as an anchor for a gag. Opposed ends of the gag are secured to the harness to retain the gag across the edentulous gap to maintain the jaws held apart and to restrain movement of the tongue. The anterior mandibular incisors are cleaned and ground into a harmonious plane. After etching the ground incisors, a bonding polymer mixture is injected into the inner proximals and additional bonding polymer mixture is placed within a mold for encapsulating the incisors. Upon positioning the mold upon the incisors, excess bonding polymer mixture is forced out intermediate the gumline and the edges of the mold. After the bonding polymer mixture has cured, the gag and harness are removed and the bovine is released. If the mold is not to become a part of the overdenture, it is removed after the bonding polymer mixture has cured.

21 Claims, 4 Drawing Sheets

PROCEDURE FOR FORMING AND ATTACHING A BOVINE DENTAL PROSTHETIC DEVICE

| |
|---|
| (A) RESTRAIN BOVINE TO PRECLUDE HEAD MOVEMENT |
| (B) ATTACH HARNESS ABOUT BOVINE'S HEAD |
| (C) INSERT GAG ACROSS AND BETWEEN JAWS OF BOVINE TO HOLD MOUTH OPEN WITHOUT INTRUDING UPON INCISORS |
| (D) SECURE OPPOSED ENDS OF GAG TO HARNESS |
| (E) SCALE AND CLEAN INCISORS |
| (F) GRIND OCCLUSAL SURFACES OF INCISORS INTO A HARMONIOUS PLANE |
| (G) BLOW DRY INCISORS |
| (H) ETCH INCISORS WITH A PREPARED SOLUTION |
| (I) APPLY RELEASE AGENT TO MOLD (OPTIONAL) |
| (J) CREATE BONDING POLYMER MIXTURE WITH OR WITHOUT ABRASIVES TO CURE WITHIN PREDETERMINED TIME PERIOD TO DESIRED HARDNESS |
| (K) PARTIAL FILL CAVITY OF PROSTHETIC MOLD WITH BONDING POLYMER MIXTURE MATERIAL |
| (L) INJECT INNER PROXIMALS OF INCISORS WITH BONDING POLYMER MIXTURE MATERIAL (FILL TO REMOVE AIR POCKETS) (OPTIONAL) |
| (M) POSITION PROSTHETIC MOLD OVER INCISORS TO FORCE THE BONDING POLYMER MIXTURE MATERIAL UPON AND ABOUT THE INCISORS |
| (N) REMOVE EXCESS BONDING POLYMER MIXTURE MATERIAL |
| (O) CURE BONDING POLYMER MIXTURE MATERIAL |
| (P) REMOVE MOLD (OPTIONAL) |
| (Q) REMOVE GAG AND HARNESS |
| (R) RELEASE BOVINE |

FIG. 14

APPARATUS AND METHOD FOR BOVINE OVERDENTURE

BACKGROUND OF THE INVENTION

1. Field of the Invention

The present invention relates to bovine tooth restoration and, more particularly, to an overdenture for placement upon the eight (8) anterior incisors present in the lower jaw of a bovine and method for installing same.

2. Description of Related Art

Cattle or bovines feed in the wild by grasping grass and other vegetation between the gum pad at the front of the upper jaw and the eight anterior incisors in the lower jaw. Such grasping, in combination with head movement, causes both a cutting and a tearing of the grasped vegetation. This vegetation includes foreign matter, such as dust, sand, grit, etc., on the surfaces thereof or otherwise forming a part thereof. The foreign matter will, over time, abrade a bovine's incisors and cause a wearing to dull the incisors and otherwise make them less effective to perform their cutting or tearing function. After a period of years, usually at about age seven (7), the effectiveness and wear of the incisors of a bovine has been severely compromised. Such reduced effectiveness reduces the amount of intake of fodder and the bovine will begin to lose weight. Additionally, the reduced fodder may compromise the health of the bovine. The final result is that the bovine either starves to death, dehydrates, or dies from diseases or injuries resulting from its reduced state of health.

The normal life span of a bovine, when not compromised by reduced effectiveness of its incisors, is in excess of 12 years. Thus, a bovine not suffering from compromised incisors has the ability to give birth to from four (4) to five (5) additional calves. The premature death of a bovine and the concomitant unborn calves represent a significant economic loss.

To date, various dental prosthetic devices have been developed to extend the effective life of the anterior incisors of a bovine. However, even though these various prosthetic devices and attendant attachment or implantation procedures are functionally and operatively sufficient to obtain the results sought, the attendant economics are not justified. That is, the prosthetic devices will require the services of skilled dentists and are time-consuming to perform. The attendant costs do not justify the benefits obtained, particularly when coupled with the inherent medical risks of any dental procedure. In addition, to date no method to attach an overdenture has been proven effective or remained in place (as installed) during the extended life period.

SUMMARY OF THE INVENTION

A mold, similar in configuration to a inverted C-channel, is used to contain a polymer mixture (plus additives) which will, when cured, bond to the mandibular eight teeth of a bovine forming an overdenture. The procedure entails stabilizing and restraining movement of a bovine's head. A gag is placed intermediate and across the bovine's jaws between the anterior teeth and the posterior molars and within the anatomically occurring space therebetween to maintain clearance of the bovine's tongue and to retain the mouth in an open position. The teeth are scaled and ground to a harmonious incisal plane and prepared to enhance the bond. The polymer mixture is placed within the mold to fill the interproximals of the anterior teeth and to bond the resultant overdenture to the buccal and lingual surface areas of the anterior teeth. After the resin has set, the mold and gag are removed. The bovine is then released.

It is therefore a primary object of the present invention to extend the effective life of the anterior incisors of a grazing animal.

Another object of the present invention is to provide a procedure for quickly mounting an overdenture upon the anterior incisors of a bovine.

Still another object of the present invention is to provide a procedure for use in the field to mount an overdenture upon the anterior incisors of a bovine.

Yet another object of the present invention is to utilize a harness for stabilizing a bovine's head while maintaining the mouth of a bovine open during a dental procedure.

A further object of the present invention is to provide a non-injurious gag to maintain a bovine's mouth open and provide tongue clearance during a dental procedure.

A still further object of the present invention is to provide a procedure useable by anyone of average dexterity, with minimal instruction, to attach an overdenture to the anterior incisors of a bovine.

A yet further object of the present invention is to provide an inexpensive and rapid procedure for attaching an inexpensive overdenture to the anterior incisors of a bovine.

These and other objects of the present invention will become apparent to those skilled in the art as the description thereof proceeds.

BRIEF DESCRIPTION OF THE DRAWINGS

The present invention will be described with specificity and clarity with reference to the following drawings, in which:

FIG. 14 illustrates a flow chart for a procedure to attach a bovine overdenture.

DESCRIPTION OF THE PREFERRED EMBODIMENT

The present invention is particularly applicable to preventive dentistry for animals such as sheep and cattle which have no maxilla (upper) anterior incisors. To fully appreciate the importance of such preventative dentistry, it may be pointed out that the useful life of a grazing animal such as a cow, for example, depends in part upon the useful life of the mandibular (lower) anterior incisors of the animal. A cow possesses only eight mandibular anterior incisors which serve to crop the grass while the upper and lower posterior molars masticate the food. If the animals grazes upon loose, sandy, or gritty soil, these anterior incisors wear down rapidly until they become known as pearlies or gummers, a pearly or a gummer is a tooth which embodies only a small part of the neck of the tooth and projects about a quarter of an inch above the gum. When the anterior incisors reach this condition, the animal is approaching the end of its useful life because, as a calf producer and calf feeder, the cow is unable to obtain enough food to support herself in healthy condition for such purposes. However, were the same cow feeding on land of a different character wherein much less of the loose gritty material is present, the animal might live a much longer productive life.

Moreover, when the pearlies or gummers become present, the root is exposed. This root is sensitive to cold water and pain results. To avoid such pain, the cows tend to refuse to drink water from troughs or other sources. A lack of water or a reduced water intake will degrade the digestion process and the amount of nutrition otherwise available is reduced. The consequences are reduced weight gain and even weight loss.

The present invention is therefore directed to forming and attaching an overdenture coupled with a procedure for applying the overdenture to the mandibular anterior incisors of a bovine to preclude wear and abrasion that otherwise would occur due to grazing and thereby prolong the useful life of the bovine. It is to be understood that implanting the overdenture described herein may also be used for other grazing animals to prolong their useful life.

Figure 1:
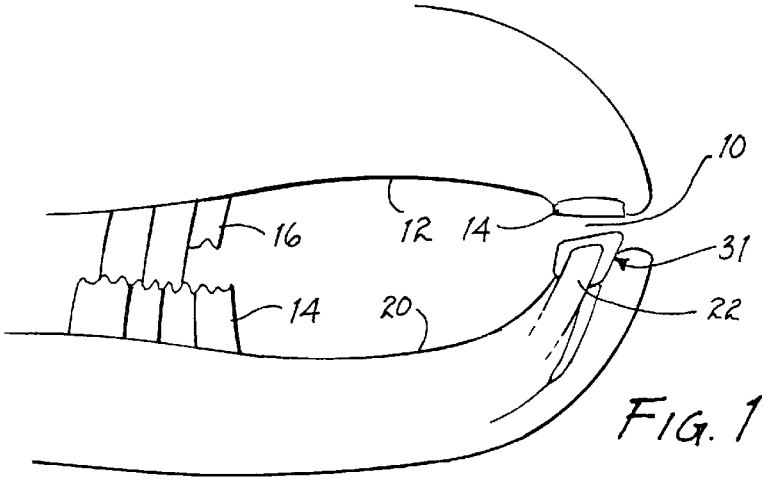
FIG. 1 is a representative side view of the jaws of a bovine.

Referring to FIG. 1, there is illustrated a side view of the mouth 10 of a cow. The upper jaw or maxilla 12 includes an anteriorly located gum pad 14. Posterior molars 16 extend downwardly. The lower jaw or mandible 20 includes eight anterior incisors, collectively referred to by reference numeral 22. Gum pad 14 serves in the manner of an anvil against which incisors 22 cut or tear the grass or fodder during grazing. Posterior molars 14 cooperate with molars 16 to masticate the regurgitated cud. As depicted in FIG. 1, a significant space, referred to as an edentulous gap, exists between the anterior incisors and the posterior molars.

Figure 2:
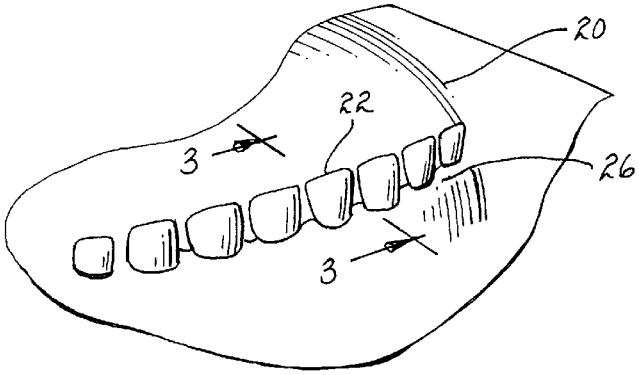
FIG. 2 is a perspective view illustrating the mandibular eight incisors of a bovine.
Figure 3:
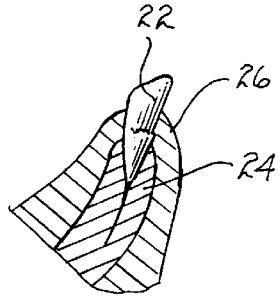
FIG. 3 is a representative cross-sectional view of a tooth taken along lines 3—3, as shown in FIG. 2.
Figure 4:
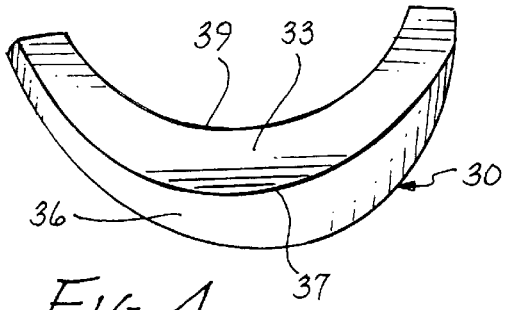
FIG. 4 illustrates an embodiment of a mold.
Figure 5:
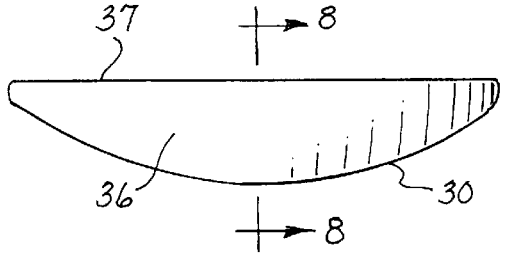
FIG. 5 illustrates a front view of the mold shown in FIG. 4.
Figure 6:
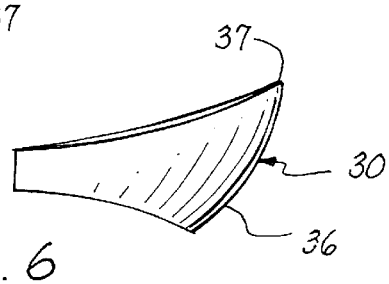
FIG. 6 illustrates a sideview of the mold shown in FIG. 4.

As shown jointly in FIGS. 2 and 3, eight incisors 22 extend upwardly from mandible 20 to form an arc in conformance with the anterior curvature of underlying bone 24. Gums 26 envelop the bone and incisors 22 protrude therefrom.

The purpose of an overdenture is that of covering or shielding one or more adjacent teeth against abrasion, cracking, or breaking. Furthermore, such overdenture, when bonded in place, has the capability of distributing stresses throughout the teeth bonded therewith, which stresses are imposed during the cutting/tearing of fodder when a bovine grazes. Mold 30 illustrated in FIGS. 4–8 is formed in the manner of an arced or curved inverted C-channel having a curvature commensurate with the arc represented by incisors 22. Center surface 32 of resultant overdenture 31 shown in FIG. 7 serves the function of cutting and/or tearing the grasses being grazed in combination with the gripping function performed by gum pad 14 (see FIG. 1).

Figure 7:
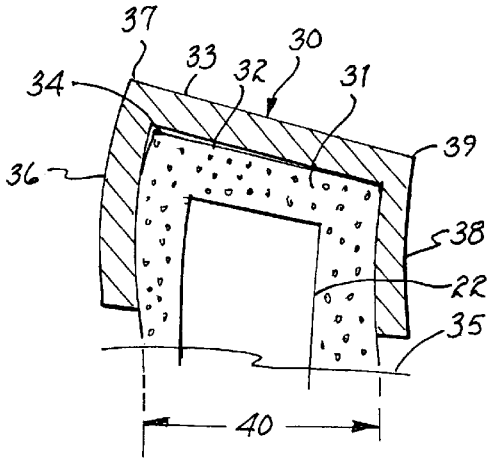
FIG. 7 is a cross-sectional view representatively illustrating a cross-sectional view of an overdenture in the process of curing before release of the mold.

As shown in FIG. 7, the configuration of overdenture 31 is determined by mold 30. The mold includes a base 33 which corresponds with and dictates the shape of center surface 32 of the overdenture. A front side wall 36 extends from proximal edge 37 of base 33 approximately to gum line 35. A rear side wall 38 from distal edge 39 of base 33 extends approximately to the gum line. Opening 40, between the lower opposed edges of the side walls must be wide enough to permit penetration of incisors 22 therethrough and permit outflow of excess polymer mix. To enhance the cutting function of the overdenture, center surface 32 may be configured by the mold to slope posteriorly downwardly to form a sharpened anterior edge 34. In order to insure removability of mold 30 after the overdenture has cured, sidewalls 36, 38 may be slightly splayed downwardly.

In the event mold 30 is to be retained attached to the overdenture, a preferred configuration of overdenture 31 can be formed. That is, a preferred cross-sectional configuration of the overdenture can be created by using a mold 30*a* having the cross-sectional configuration shown in FIG. 8. Front side wall 36*a*, depending from proximal edge 37*a* of base 33*a*, and rear side wall 38*a*, depending from distal edge 39*a*, slope downwardly and curve toward one another to generally conform with the corresponding cross-section of incisors 22 (see FIG. 8). Necessarily, opening 40*a*, through which incisors 22 are inserted upon placement of mold 30*a* thereupon, must be wide enough to accommodate the incisors. Moreover, the width and depth of the mold must be sufficient to permit a polymer mix deposited within the mold to coat the incisors.

The overdenture is permanently retained in place by the curing/hardening of the polymer mixture material that will preclude separation of the overdenture from the incisors over the remaining life of the animal. To ensure both chemical and mechanical attachment, mold 30 may be partially filled with the polymer mixture (or bonding polymer mixture) and thereafter brought into engagement with incisors 22. Upon such engagement, the polymer mixture will come into contact with the surfaces of the incisors and be forced into inner proximals of the incisors. Nevertheless, excess polymer mixture may have been used. Such excess may ooze out through opening 40 adjacent the gums. As particularly shown in FIG. 7, polymer mixture, forming the overdenture on curing/hardening, is dispersed within mold 30 and in contact with the anterior, posterior, and proximal surfaces of incisors 22.

Prior to being put out on the range, calves or steers are vaccinated and sometimes dehorned. Each animal is placed in a holding apparatus known as a "chute" which includes sides for holding the body and the head essentially still. Since this normal event is undergone by every animal, it provides an excellent opportunity for implanting an overdenture with minimal additional time, expense, and labor.

Figure 9:
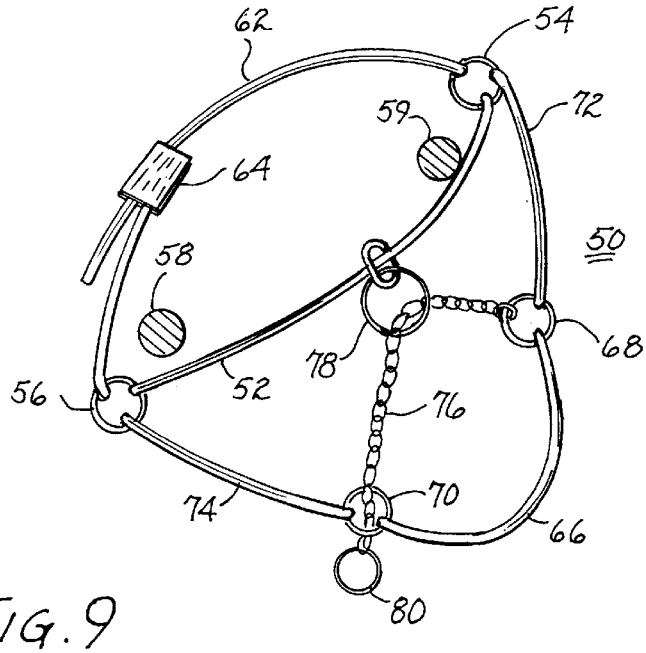
FIG. 9 is a perspective view of a harness for use about a bovine's head.

Referring to FIG. 9, there is illustrated a representative head harness 50 to be placed upon the animal. The main purpose and function of this harness is to retain in place a gag for maintaining the animal's jaws apart and to restrain tongue movement to prevent interference with implantation of an overdenture. The harness includes a strap 52 connected to rings 54,56, which strap is placed in front of horns 58,59. An adjustable strap 62 extends from rings 54,56 and includes a buckle 64 for securing strap 52 in place. A chin strap 66 extends from rings 68,70. These rings are interconnected with strap 52 through straps 72,74 extending between rings 54,68 and 56,70, respectively. A chain 76 extends over and across the animal's bridge. It is looped through a ring 78 attached to strap 52 and interconnects with ring 68. To permit adjustability, the to chain may extend through ring 70 and may include a ring 80 at its terminal end to prevent withdrawal through ring 70 as well as to provide for adjustability.

In summary, the function and purpose of harness 50 is that of serving as an anchoring means for a gag to be attached thereto. Accordingly, the anchoring elements of the harness must be reasonably fixed relative to the jaws of the animal to prevent untoward movement of an attached gag.

Figure 10:
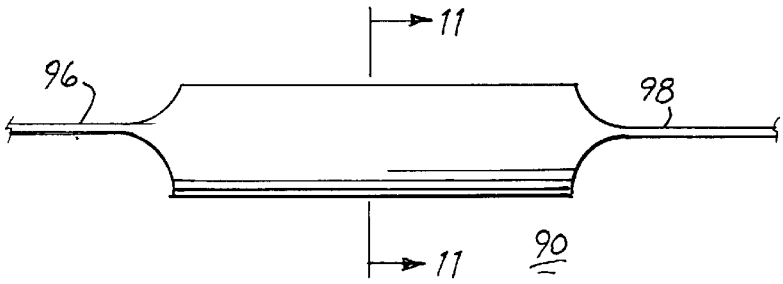
FIG. 10 is a simplified view of a gag useable in combination with the harness shown in FIG. 9.
Figure 11:
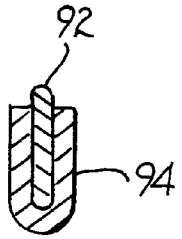
FIG. 11 is a cross-sectional view taken along lines 11—11, as shown in FIG. 10.
Figure 11A:
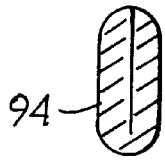
FIG. 11*a* illustrates a variant cross-sectional view of a gag and taken along lines 11—11, as shown in FIG. 10.

A representative gag 90 is illustrated in FIGS. 10, 11 and 11*a*. The gag is formed of absorbent material for absorbing saliva excreted by the animal during the procedure. As depicted in FIG. 11, absorbent material 92 may be partially or fully enveloped within canvas 94 or other cloth which serves primarily a protective function for the absorbent material and should be soft enough not to inflict injury or significant abrasion to adjacent soft gum tissue. Alternatively, the canvas or similar material may be folded one or more times as depicted in FIG. 11*a* without enveloping or including any absorbent material; or, the material may be moisture absorbent material if it is of sufficient strength to withstand the stresses imposed.

The purpose of the gag is that of spreading and maintaining apart the animal's upper and lower jaws to permit access to the anterior incisors and without interference by the animal's tongue. To spread the animal's jaws far enough apart, it is preferable that the gag have an effective height in the range from about 3 inches to about 5 inches. In practice, a 4-inch high gag has been found sufficient considering the size and age of the animals upon which experiments have been conducted.

Gag 90 is retained in place by elements, such as tie ropes 96,98 extending from opposed ends. These tie ropes are secured to rings 70,68, respectively, of harness 50. Because rings 70,68 are essentially positionally fixed by the harness, and as gag 90 is attached to these rings, the gag will remain essentially fixed between the jaws of the animal intermediate the anterior incisors and the posterior molars within the edentulous gap. Furthermore, the pressure exerted by the gag upon the tongue will not cause injury to the tongue and yet the tongue will be sufficiently restrained to prevent it from interference with implantation of an overdenture.

Figure 12:
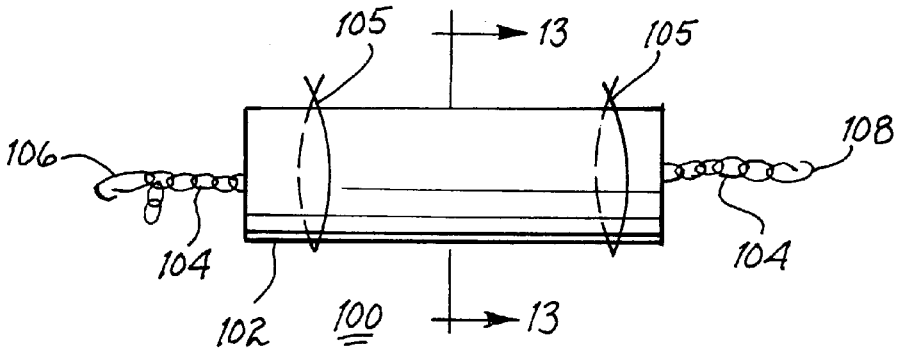
FIG. 12 illustrates a variant gag.
Figure 13:
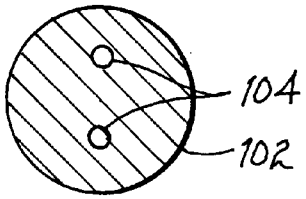
FIG. 13 is a cross-sectional view taken along lines 13—13, as shown in FIG. 12.
Figure 13A:
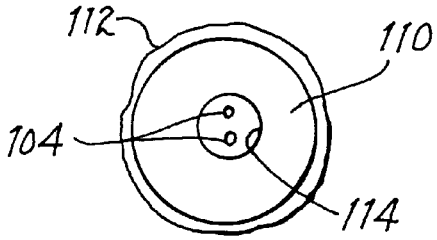
FIG. 13*a* is a cross-sectional view of a variant gag construction.

Referring jointly to FIGS. 12, 13, and 13*a*, a further type of gag 100 found useful will be described. This gag includes essentially a roll 102 of material wrapped about a chain 104 extending therethrough. The roll may be formed by paper or cloth wrapped about the chain and secured by conventional plastic tie wraps 105. Such material is inexpensive and readily available. Moreover, it is soft enough to prevent injury to the soft tissues in the mouth of the animal and is absorbent enough to prevent a flow of saliva to and about the anterior incisors. To permit multiple uses of gag 100, a roll of paper towels 110, or the like, may be enveloped within a protective sheath 112 of water permeable canvas or the like, as shown in FIG. 13*a*. Chain 104 would extend penetrably through center passageway 114 of the roll of the paper towels, as illustrated. It is to be understood that water impervious gags could also be used where absorption of saliva is not important or where collection and disposal of saliva is performed by other apparatus or processes.

To permit facile attachment and detachment of gag 100 from harness 50, opposed ends of chain 104 may include clips 106,108 for attachment to respective rings 68,70 of the harness. This will permit replacement of gag 100 as necessary in a very simple and cost-effective manner. Moreover, if gag 100 is a common roll of paper towels, chain 104 may be readily inserted through the hollow core of such paper towel roll. Thus, the same chain may be reused continually with replacement gags being mounted thereon on an "as necessary" basis.

Referring to FIG. 14, there is illustrated in block diagram form the steps of a procedure for attaching a dental prosthetic device, or overdenture to the anterior incisors of a bovine or other grazing animal having a similar dental configuration. Restraint of the bovine is readily carried out by placing the bovine in a conventional squeeze chute. It is appreciated that if the procedure is performed in the field (on the range), other restraint means may have to be undertaken to maintain the bovine's head essentially still to carry out the procedure. Harness 50 is attached to the bovine's head to provide an anchor for a gag. The gag (90 or 100) is placed between the jaws of the bovine within the edentulous gap and the opposed ends of the gag are secured to the harness rings 68,70. Upon installation of the gag, the anterior incisors are available for a dentist or technician to install the overdenture.

Figure 8:
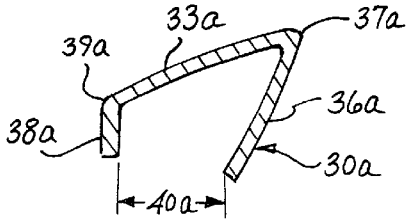
FIG. 8 is a cross-sectional view taken along lines 8—8, as shown in FIG. 5.

To prepare the incisors, they are scaled and cleaned. Because wear may not have been uniform and as there may be broken or missing teeth, the occlusal surfaces are ground into essentially a harmonious plane. To ensure effective subsequent chemical reaction, the incisors are blown dry; the saliva absorbing characteristic of the gag is useful to reduce the amount of saliva present and to stem further flow of saliva to the incisors. To enhance bonding, the incisors are etched with an etching solution. A release agent may be applied to the mold to prevent bonding and facilitate mold removal after curing of the polymer mixture, unless the mold is to become part of the overdenture (as depicted in FIG. 8). The polymer mixture may be prepared with mixed abrasives, stage cured for workable flow characteristics and optimum cure time after application. The cavity formed by the mold is partially filled with the polymer mixture material. To ensure essentially complete encapsulation of the incisors the polymer mixture material may be injected into the inner proximals of the incisors. The mold is placed over the incisors and forced downwardly there against to cause the polymer mixture material to flow about the incisors with any excess being discharged around the gumline. By having the polymer mixture forced down to the gumline, a more effective seal about the teeth and mechanical attachment is achieved. The excess material exposed at the gum line is removed by wiping or other conventional techniques. After the mold is implanted, it must not be disturbed until the polymer mixture material has cured. After curing, the mold, the gag and harness are removed and the bovine may be released, obviously, if the mold is to be left as part of the overdenture, no release agent would be used and removal of the mold would not be attempted.

The procedure described above is a relatively simple dental procedure that may be easily taught. With some practice, any person, with average dexterity, would readily be able to implant the overdenture. Thus, the special services of either a dentist or a veterinarian, and attendant expenses, can be obviated. The procedure is thus an economical procedure that will produce weight gain, longevity, and calf bearing benefits significantly in excess over the costs associated with the overdenture implantation procedure described herein.

While the invention has been described with reference to several particular embodiments thereof, those skilled in the art will be able to make the various modifications to the described embodiments of the invention without departing from the true spirit and scope of the invention. It is intended that all combinations of elements and steps which perform substantially the same function in substantially the same way to achieve the same result are within the scope of the invention.

What is claimed is:

1. A method for implanting an overdenture upon the mandibular anterior incisors of an animal, said method comprising the steps of:

(a) restraining movement of the head of the animal;

(b) mounting a harness about the animal's head;

(c) locating a gag between the jaws of the animal to maintain the jaws open and to restrain movement of the tongue and securing the gag to the harness to retain the gag in place;

(d) bonding an overdenture to the incisors to provide a cutting surface during grazing; and (e) removing the gag and harness from the animal upon completion of said bonding step.

2. The method as set forth in claim 1 including the step of grinding the incisors to a harmonious plane prior to exercise of said bonding step.

3. The method as set forth in claim 2 including the step of cleaning the incisors prior to said grinding step.

4. The method as set forth in claim 1 wherein said bonding step includes the step of injecting a bonding polymer mixture into the inner proximals of the incisors.

5. The method as set forth in claim 1 wherein said bonding step includes the step of inserting a bonding polymer mixture within a mold defining the overdenture and placing the mold upon the incisors to encapsulate the incisors with the bonding polymer mixture.

6. The method as set forth in claim 5 wherein said bonding step includes the step of injecting a bonding polymer mixture into the inner proximals of the incisors.

7. The method as set forth in claim 5 including the steps of coating the interior of the mold with a release agent and wherein said step of removing includes the step of removing the mold.

8. The method as set forth in claim 5 including the step of forcing the mold onto the incisors to urge a flow of bonding resin about the incisors to the gumline.

9. The method as set forth in claim 8 wherein said step of removing includes the step of removing excess bonding polymer mixture forced out between the gumline and the mold.

10. The method as set forth in claim 1 including the step of mixing an abrasive in the bonding polymer mixture.

11. Apparatus for maintaining the jaws of an animal apart during implantation of an overdenture upon the mandibular anterior incisors, said apparatus comprising in combination:

(a) a harness attachable about the head of the animal, said harness including straps extending across the nose and under the lower jaw;

(b) a gag locatable between and across the jaws of the animal to maintain the jaws spaced apart, to restrain movement of the tongue, to absorb saliva and to expose the incisors; and (c) means for securing opposed ends of said gag to said harness.

12. The apparatus as set forth in claim 11 wherein said securing means is adapted to locate said gag within the edentulous gap of a grazing animal.

13. The apparatus as set forth in claim 12 wherein said gag includes water absorbing materials.

14. The apparatus as set forth in claim 13 wherein said gag includes a water permeable cover for said water absorbing materials.

15. The apparatus as set forth in claim 12 wherein said securing means comprises a chain disposed within and extending through said gag.

16. The apparatus as set forth in claim 15 including clips for attaching said chain to said harness.

17. The apparatus as set forth in claim 15 wherein said gag comprises a roll of paper having a passageway extending therethrough for receiving said chain.

18. The apparatus as set forth in claim 17 including clips for attaching said chain to said harness.

19. The apparatus as set forth in claim 11 wherein said securing means includes clips for engaging said harness.

20. The apparatus as set forth in claim 11 wherein said gag includes an outer surface of cloth for contacting the gums of the animal.

21. The apparatus as set forth in claim 20 wherein said securing means is enveloped by said outer surface and comprises a chain and clips for securing said chain to said harness.

* * * * *